US007336027B2

(12) United States Patent
Yamazaki et al.

(10) Patent No.: US 7,336,027 B2
(45) Date of Patent: Feb. 26, 2008

(54) PLASMA TUBE ARRAY AND GAS DISCHARGE TUBE

(75) Inventors: Yosuke Yamazaki, Kawasaki (JP); Manabu Ishimoto, Kawasaki (JP); Hitoshi Yamada, Kawasaki (JP); Hitoshi Hirakawa, Kawasaki (JP); Akira Tokai, Kawasaki (JP); Koji Shinohe, Kawasaki (JP); Kenji Awamoto, Kawasaki (JP)

(73) Assignee: Shinoda Plasma Corporation, Akashi (JP)

( * ) Notice: Subject to any disclaimer, the term of this patent is extended or adjusted under 35 U.S.C. 154(b) by 214 days.

(21) Appl. No.: 11/155,541

(22) Filed: Jun. 20, 2005

(65) Prior Publication Data

US 2006/0214554 A1 Sep. 28, 2006

(30) Foreign Application Priority Data

Mar. 23, 2005 (JP) ..... 2005-084046

(51) Int. Cl.
*H01J 17/49* (2006.01)

(52) U.S. Cl. ..... 313/485; 313/488; 313/493; 313/582

(58) Field of Classification Search ..... 313/484–493, 313/582–587
See application file for complete search history.

(56) References Cited

U.S. PATENT DOCUMENTS 5,514,934 A * 5/1996 Matsumoto et al. ..... 313/607
7,049,748 B2 * 5/2006 Tokai et al. ..... 313/582

FOREIGN PATENT DOCUMENTS

| | | |
|---|---|---|
| JP | 61-103187 | 5/1986 |
| JP | 2003-086141 | 3/2003 |
| JP | 2003-272562 | 9/2003 |

* cited by examiner

*Primary Examiner*—Ashok Patel
(74) *Attorney, Agent, or Firm*—Staas & Halsey LLP

(57) ABSTRACT

A plasma tube array according to the present invention includes plural light emitting tubes that have fluorescent material layers inside and are mutually lined up in parallel. The plasma tube array includes pairs of display electrodes that are formed along the respective fluorescent material layers. The fluorescent material layers are disposed in sequence in the longitudinal direction of the light emitting tubes.

4 Claims, 8 Drawing Sheets

PLASMA TUBE ARRAY AND GAS DISCHARGE TUBE

BACKGROUND OF THE INVENTION

1. Field of the Invention

The present invention relates to a plasma tube array and a gas discharge tube used for the plasma tube array, in which plural light emitting tubes each having fluorescent material layers inside are lined up, and electric discharge is generated within those plural light emitting tubes so as to allow the fluorescent material layers within the light emitting tubes to emit light, thereby displaying an image.

2. Description of the Related Art

In general, as a large size image display apparatus performing an auto light generation, there has been disclosed a technique which makes use of a principle of plasma display to allow the light emitting thread made of tube (glass tube) of glass having fluorescent material layer and the like inside to line up in a large number and control light emission for each portion of each light emitting thread, thereby displaying an image (Japanese Patent Laid-Open No. 61-103187).

An individual light emitting thread is a thread, which forms an MgO layer and a fluorescent material layer, and for example, seals a discharge gas made of Ne and Xe into the glass tube. The fluorescent material layer is formed on a support member referred to as a boat, which is a mounting part having a cross sectional shape close to a semi-circle, and the support member (boat) is inserted into the glass tube. After that, the glass tube is evacuated, while being heated inside a vacuum chamber, and after being filled up with the discharge gas, both ends thereof are molten and sealed. The light emitting threads thus prepared are lined up and fixed in a large number, and at the same time, electrodes are provided above and below those light emitting threads, and those electrodes are applied with voltage, whereby discharge is generated inside the light emitting threads so as to allow fluorescent materials to emit light.

FIG. 1 is an oblique view showing a basic structure of the plasma tube array.

The plasma tube array (PTA) 100 shown here is disposed with light emitting threads 10R, 10G, 10B, 10R, 10G, 10B . . . incorporating therein fluorescent material layers that emit fluorescent lights of red (R), green (G), and blue (B), respectively. Each of the light emitting threads 10R, 10G, 10B, 10R, 10G, 10B . . . sealed with the discharge gas is sheet-like and lined up mutually in parallel. The front surfaces and rear surfaces of a large number of those lined up light emitting threads 10R, 10G, 10B, 10R, 10G, 10B . . . are disposed with a transparent front surface support substrate 20 and a transparent rear surface support substrate 30, respectively, and a large number of those lined up light emitting threads 10R, 10G, 10B, 10R, 10G, 10B . . . are formed so as to be held by the front surface support substrate 20 and the rear surface support substrate 30 between them.

Further, on the front surface support substrate 20, there are formed pairs of display electrodes 21 mutually extending in parallel, which are made of two pieces of display electrodes 211 and 212 in the lined up direction of a large number of light emitting threads 10R, 10G, 10B, 10R, 10G, 10B . . . , that is, in the direction to cross a number of those light emitting threads 10R, 10G, 10B, 10R, 10G, 10B . . . . This pair of display electrodes 21 is lined up in plural numbers in the longitudinal direction of the light emitting threads 10R, 10G, 10B, 10R, 10G, 10B . . . . Further, two pieces of display electrodes 211 and 212 making up one pair of display electrodes 21 have bus electrodes 211*a* and 212*a* made from metal (for example, Cr/Cu/Cr) formed at a mutually isolated side, respectively, and transparent electrodes 211*b* and 212*b* made up of an ITO thin film formed at a mutually adjacent side, respectively. The bus electrodes 211*a* and 212*a* are for lowering the electric resistance of the display electrodes 211 and 212, and the transparent electrodes 211*b* and 212*b* are devices for performing a bright display by allowing emission lights to transmit toward the front surface support member 20 side without shutting out the emission lights at the light emitting threads 10R, 10G, 10B, 10R, 10G, 10B . . . . Here, the pair of electrodes 21 may be formed of not only the transparent electrodes, but also the electrodes having a structure of high opening ratio such as mesh electrodes and the like.

Further, on the rear surface support substrate 30, there are formed multiple metallic signal electrodes 31. The signal electrodes 31 extend mutually in parallel along the respective multiple lined up light emitting threads 10R, 10G, 10B, 10R, 10G, 10B . . . , with the correspondence therebetween.

In case the PTA 100 thus formed is seen two-dimensionally, a cross over portion with the signal electrode 31 and the pairs of display electrodes 21 becomes a unit light emitting area (unit discharge area) The display is performed in such a manner that either one of the display electrode 211 or 212 is used as a scanning electrode, and at the cross over portion with the scanning electrode and the signal electrode 31, a selective discharge is generated so as to select a light emitting area, and accompanied with this discharge, by utilizing a wall charge formed in the inner surface of the light emitting thread in the light emitting area, the display discharge is generated between the display electrodes 211 and 212. The selective discharge is an opposed discharge, which is generated inside the light emitting thread between the scanning electrode and signal electrode 31 that are opposed above and below, and the display discharge is a surface discharge, which is generated inside the light emitting thread between the display electrodes 211 and 212 disposed in parallel on a flat surface. Through such electrode arrangement, the interior of the light emitting thread is formed with plural light emitting areas in the longitudinal direction.

Here, though the electrode structure of the drawing is a structure in which three electrodes are disposed in one light emitting area, and it is a structure in which the display electrodes 211 and 212 generate the display discharge, but it is not intended to be limited to this, and it may be a structure in which the display discharge is generated between the display electrodes 211 and 212 and the signal electrode 31. That is, it may be an electrode structure of the type in which the display electrodes 211 and 212 are made one piece, and this one piece of the display electrode is used as a scanning electrode so as to generate the selective discharge and the display discharge (opposed discharge) with the signal electrode 13.

FIG. 2 is a schematic illustration showing a structure for one pixel of the plasma tube array 100 shown in FIG. 1.

Here, three pieces of light emitting threads 10R, 10G, and 10B are shown. Each of the light emitting threads 10R, 10G, and 10B has a protective film 12 of a material such as MgO or the like formed in the inner surface of the glass tube 11, and is formed such that, inside the glass tube 11, there is inserted a boat 13 which is a support member formed with each of the fluorescent material layers 14R, 14G, and 14B that emit each fluorescent light of each color of R, G, and B (see Japanese Patent Laid-Open No. 2003-86141).

FIG. 3 is a view showing a boat in which the fluorescent material layer is formed.

The boat 13 is shaped in a semi-circular in cross section or shaped similarly to it, and has the same long extended shape as the glass tube 11 (see FIG. 2), and in the interior thereof, there are formed three types of the fluorescent material layers 14R, 14G, and 14B (see FIG. 2; in FIG. 3, they are collectively referred to as a fluorescent layer 14) corresponding to three types of the light emitting threads 10R, 10G, and 10B as shown in FIGS. 1 and 2.

Referring back to FIG. 2, the description will be continued.

Each of the light emitting threads 10R, 10G, and 10B shown in FIG. 2 is made up with the boat 13 of the shape shown in FIG. 3 inserted inside the glass tube 11. In FIG. 2 is shown that, on these light emitting threads 10R, 10G, 10B, there are disposed a pair of display electrodes 21 having two pieces of display electrodes 211 and 212. These two pieces of display electrodes 211 and 212, as described above, are made up of the metallic bus electrodes 211*a* and 212*a* and the transparent electrodes 211*b* and 212*b*.

Here, in the case of the structure shown in FIG. 2, three pieces of light emitting threads 10R, 10G, and 10B having three types of the fluorescent material layers 14R, 14G, and 14B, respectively are made one set, and moreover, an area D1 defined by a set of the pair of display electrodes 21 having two pieces of display electrodes 211 and 212 becomes one pixel (1 pixel), which is a unit of a color image display. The diameter of each of the light emitting threads 10R, 10G, and 10B is typically approx. 1 mm, and in the case of the structure shown in FIG. 2, the size of the area D1 of one pixel is 3 mm×3 mm.

Here, the glass tube 11 used in the light emitting threads 10R, 10G, and 10B is difficult to make significantly smaller in diameter than a diameter of 1 mm due to necessity of securing the strength. Further, even if the glass tube of a small diameter can be prepared, the smaller in diameter the glass tube is made, the more it is difficult to dispose a protective layer and a fluorescent material layer inside the glass tube. Hence, to realize the light emitting thread made significantly smaller in diameter than a diameter of 1 mm, a significant increase of the cost is anticipated.

In the meantime, it is desired to display a highly precise image, which does not have a size of one pixel larger than 3 mm×3 mm, but smaller than that size.

In Japanese Patent Laid-Open No. 2003-272562, there has been disclosed a structure, which disposes a boat having two walls extending in the longitudinal direction inside the flat glass tube, and mounts three types of the fluorescent material layers emitting fluorescent lights of three colors of R, G, and B inside the boat. The technique of this patent publication adopts a flat glass tube aiming at reducing the number of glass tubes, and lines up and disposes three types of the fluorescent material layers extending in the longitudinal direction of the glass tube within one piece of that glass tube. When such arrangement can be realized within the glass tube having a diameter of approx. 1 mm, three types of the fluorescent material layers are lined up in the diameter direction of one piece of the glass tube, and the size of the pixel can be reduced by ⅓ (1 mm) with respect to the diameter direction of the glass tube.

However, according to the technique of this patent publication, since two pieces of rib-shaped partitions extending in the longitudinal direction for compartmentalizing three types of the fluorescent material layers in the boat are formed, there is a problem that the opening portions for emitting the fluorescent lights are narrowed by those partitions, thereby displaying a dark image. Further, assuming that the boat in the shape of having removed these partitions is prepared, and three types of the fluorescent material layers are coated according to the patent document, the shapes of the fluorescent material layers at both sides and the fluorescent material layer in the center become dissimilar, and from among three types of the fluorescent material layers, one type of the fluorescent material layer in the center alone differs from the others in the light emission efficiency due to difference in its shape.

SUMMARY OF THE INVENTION

The present invention has been made in view of the above circumstances and provides a plasma tube array, and a gas discharge tube suitable to be used for the plasma tube array, which can reduce the size of one pixel without making light emitting threads smaller in diameter and can realize a highly precise image display.

A plasma tube array according to the present invention has:

plural light emitting tubes that each have a fluorescent layer inside thereof and are mutually lined up in parallel;

a front surface support substrate and a rear surface support substrate that holds the plural light emitting tubes between themselves;

plural display electrodes that are formed on a surface, which faces the light emitting tubes, of the front surface support substrate in the direction to cross the light emitting tubes; and plural signal electrodes that are associated with the respective light emitting tubes and formed on a surface, which faces the light emitting tubes, of the rear surface support substrate in the direction along the light emitting tubes, wherein the fluorescent layer of each of the light emitting tubes includes plural types of fluorescent materials emitting fluorescent lights of different colors, the fluorescent materials being disposed in sequence in the longitudinal direction of the light emitting tubes, and wherein the display electrodes are associated with the respective fluorescent materials that are disposed in sequence in the longitudinal direction of the light emitting tubes.

The plasma tube array of the present invention is provided with the light emitting tubes including plural types of fluorescent materials which are disposed in sequence therein and emit the fluorescent lights of different colors in the longitudinal direction, and the display electrodes are provided along the respective fluorescent materials disposed in sequence in the longitudinal direction of the light emitting tubes. Therefore, without reducing the diameter of the light emitting tube, the size of one pixel is made small, and a highly precise image can be displayed.

In the plasma tube array according to the present invention, the display electrodes may be each formed along corresponding one of the plural types of fluorescent materials that emit in sequence fluorescent lights of different colors across the light emitting tubes.

When plural types of fluorescent materials are lined up in sequence two-dimensionally in this manner, not only the resolution in a X direction where the light emitting tubes extend as well as in a y direction where the light emitting tubes are lined up, but also the resolution in an oblique direction are increased, thereby a much highly precise image can be realized.

Further, in the plasma tube array according to. the present invention, the fluorescent layer may include fluorescent materials that are disposed in sequence to be different in size in the longitudinal direction of the light emitting tubes depending on the type of the fluorescent materials.

Light emitting strength of the fluorescent material is different depending the type of the florescent material. Hence, when the size in the longitudinal direction is made different according to the type of the fluorescent material, without making any particular device on the image signal, regardless of the type of the fluorescent material, the fluorescent light of a definite light emitting strength can be emitted.

Furthermore, the plasma tube array according to the present invention may include a support member in which plural types of fluorescent materials emitting fluorescent lights of different colors are disposed in sequence, and the support member may be inserted into the light emitting tube.

A gas discharge tube according to the present invention has a tubular container forming a discharge space and a fluorescent layer disposed inside the tubular container, and the gas discharge tube includes:

a support member that is independent of the tubular container, wherein the fluorescent layer includes plural types of fluorescent materials that emit fluorescent lights of different colors and are formed in sequence on the support member in the longitudinal direction of the tubular container, and wherein the support member is inserted into the tabular container so as to be disposed within the discharge space.

According to the present invention, without making the diameter of the light emitting thread (light emitting tube) small, the size of one pixel is reduced and a highly precise image display can be realized.

DETAILED DESCRIPTION OF THE INVENTION

Each embodiment of the present invention will be described below.

Figure 1:
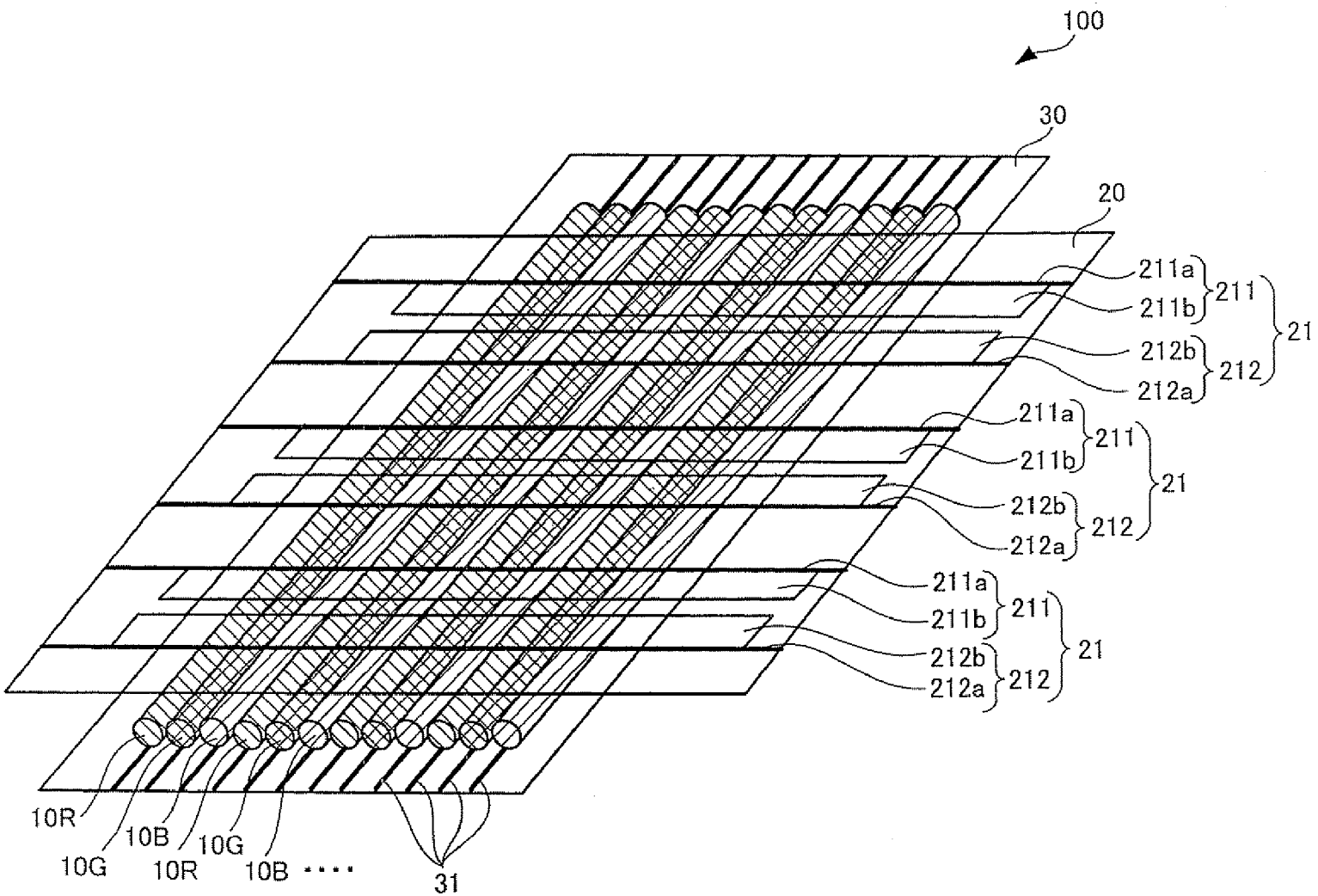
Fig. 1 PRIOR ART
FIG. 1 is an oblique view showing a basic structure of a plasma tube array.

Each embodiment to be described below, comparing with the related art (FIGS. 1 to 3) described so far, is different only in the array structure of the fluorescent material layers on the boat and installation intervals of the pair of display electrodes. Consequently, in each embodiment to be described below also, the entire structure should be referred to FIG. 1 as it is, and here, the description will be focused on the characteristic portion of the present invention.

Figure 4:
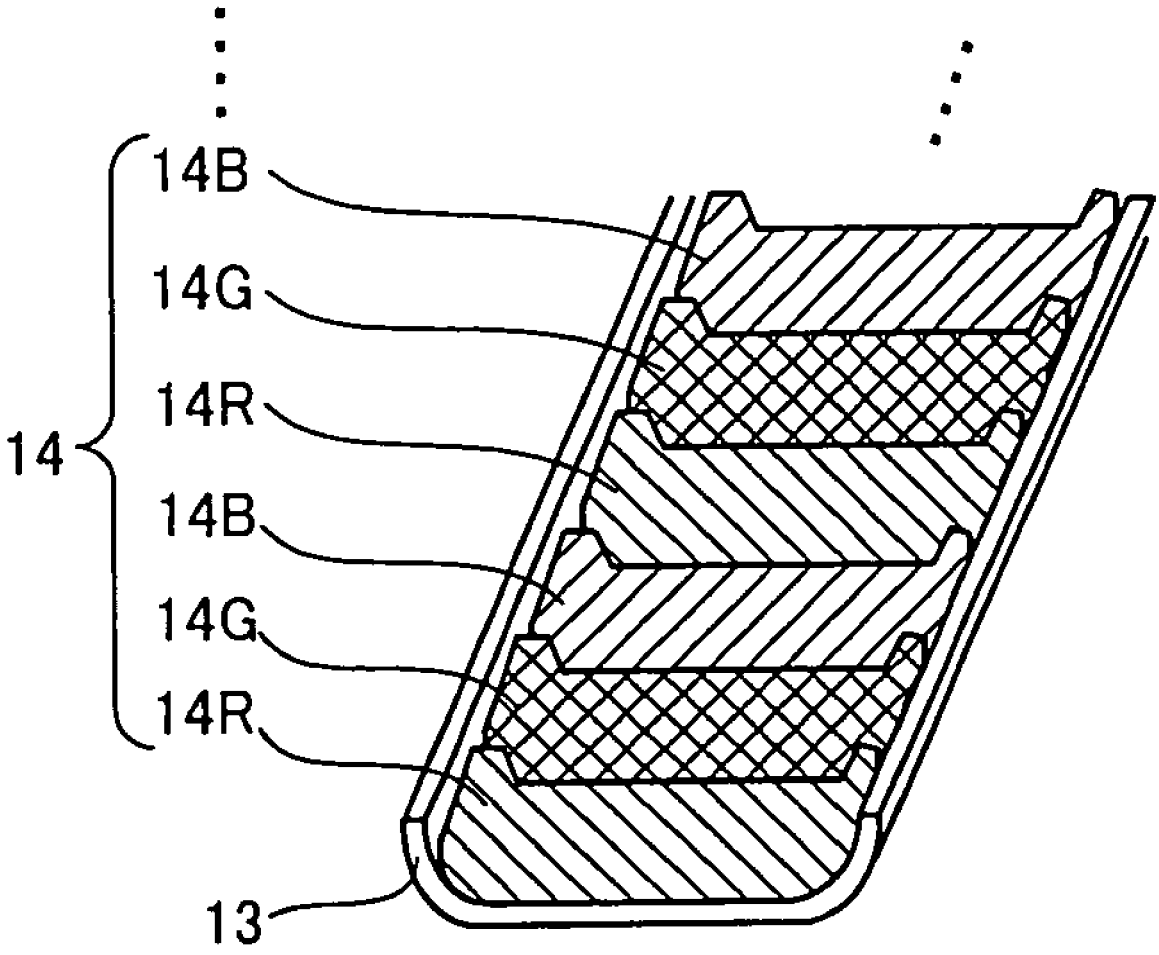
FIG. 4 is a view showing an array structure of the fluorescent material layers on the boat, which is a fluorescent support member in the plasma tube array of a first embodiment of the present invention.

FIG. 4 is a view showing the array structure of the fluorescent material layers on the boat, which is the fluorescent support member in the plasma tube array of a first embodiment of the present invention.

Here, on the boat 13, there is a fluorescent layer 14 composed of sequentially lined up three types of the fluorescent material layers 14R, 14G, 14B, 14R, 14G, 14B . . . that emit each of the florescent lights of three colors of R, G, and B in the longitudinal direction of the boat 13. These fluorescent material layers 14R, 14G, 14B, 14R, 14G, 14B . . . are formed in such a manner that an opened mask is arranged only on a portion where the fluorescent material intended to be coated so as to perform a screen printing, whereby the coated fluorescent material layers 14R, 14G, 14B, . . . are formed on the boat 13 as shown in FIG. 4.

Figure 5:
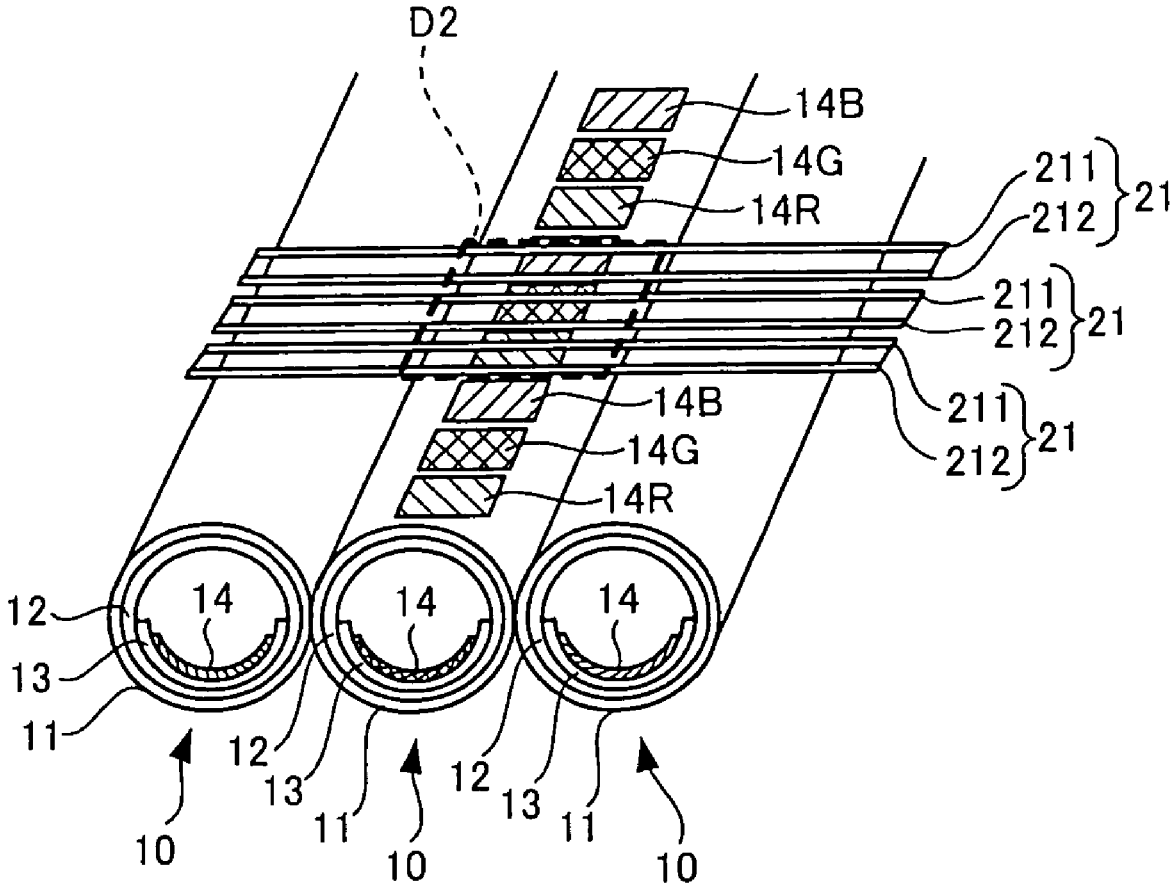
FIG. 5 is a view showing the light emitting threads of the first embodiment.

FIG. 5 is a view showing the light emitting threads of the first embodiment.

The light emitting thread 10 shown here takes a glass tube 11 of 1 mm in diameter (0.1 mm in thickness) and 100 cm in total length and the boat 13 of 0.75 mm in width size as materials, and there are disposed in sequence therein the fluorescent material layers 14R, 14G, 14B . . . that emit the fluorescent lights of red (R), green (G), blue (B) in this order on the boat 13 by using a screen printing technique at 0.3 mm width intervals in the longitudinal direction. It should be noted that, here also, when the fluorescent material layers are referred to without classifying them into types, they are just collectively referred to as a fluorescent layer 14. The boat 13 having thus disposed fluorescent layer 14 is put into a furnace so as to calcinate the fluorescent layer 14, and after that, this boat 13 is put into the glass tube 11 formed with the MgO film 12, and the discharge gas is enclosed into the glass tube 11, and both ends of the glass tube 11 are sealed.

The light emitting threads 10 thus formed are lined up, whereby the fluorescent material layers of the same type are adjacently lined up, and are held between and fixed by the front surface and the rear surface, for example, by the front surface support substrate and the rear surface support substrate such as glass substrates (not shown). From among these substrates, the front surface support substrate disposed in the front surface is formed with a pair of display electrodes 21 at 0.3 mm pitch intervals, and the pair of display electrodes 21 are aligned to the. arrangement of the fluorescent material layers inside the light emitting thread 10.

Figure 2:
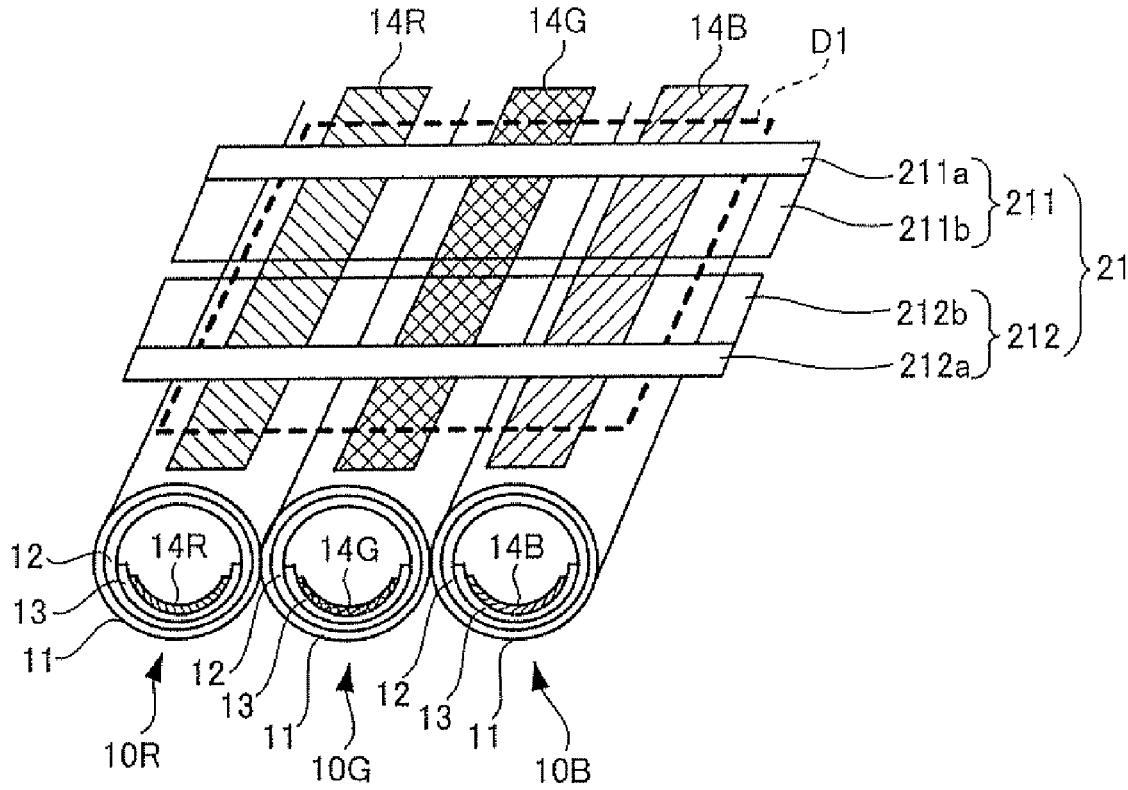
Fig. 2 PRIOR ART
FIG. 2 is a schematic illustration showing the structure of one pixel portion of the plasma tube array shown in FIG. 1.
Figure 3:
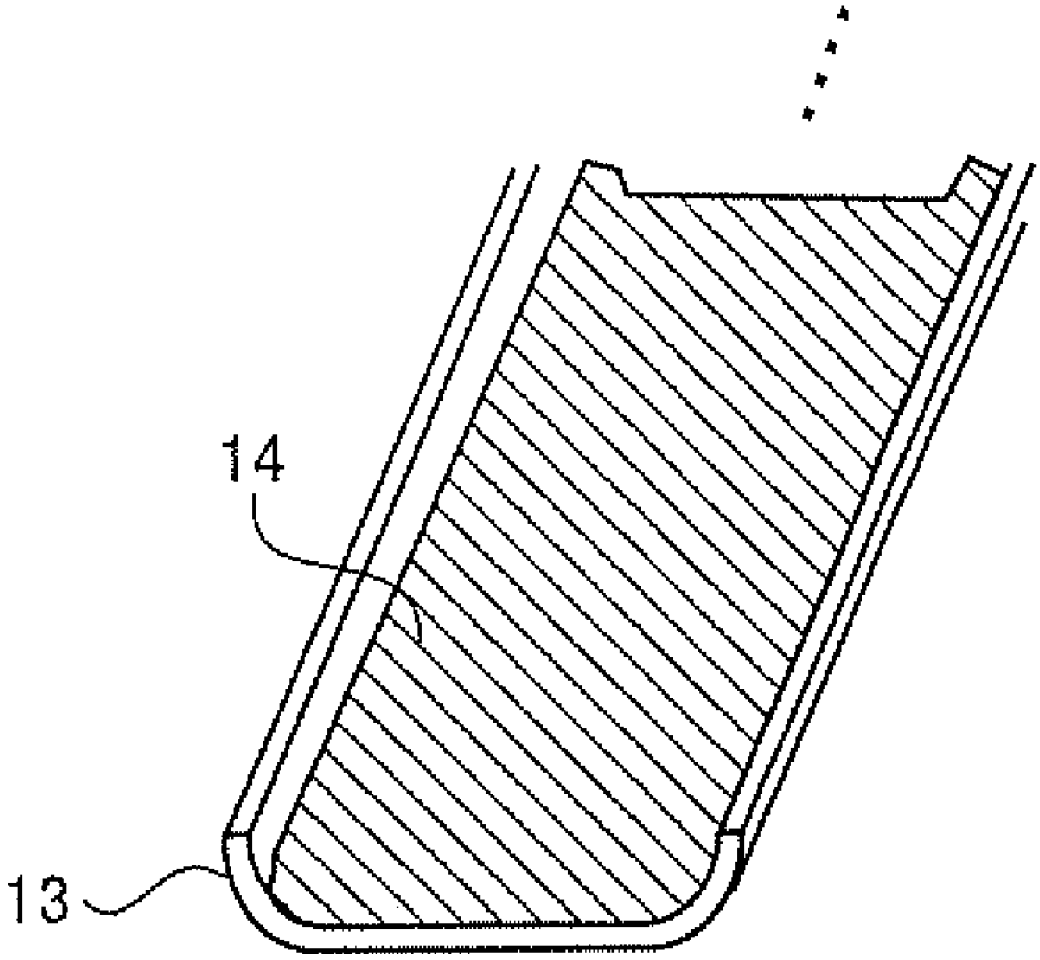
PRIOR ART Fig. 3
FIG. 3 is a view showing a boat in which fluorescent material layers are printed and formed.

It should be noted that, on the rear surface support substrate, as shown in FIG. 2, the signal electrodes 31 are formed, but the illustration thereof is omitted.

In the case of the present structure, though the alignment between the fluorescent material layers and the pair of display electrodes that was unnecessary in the conventional light emitting thread array as shown in FIG. 2 becomes necessary, the position of each of the fluorescent material layers is definable with the end surface of the boat 13 taken as a base point. Further, the glass tube 11 and the boat 13 are accurately welded. Hence, it is possible to strictly define the positional relation between the end surface of the light emitting thread 10 and the fluorescent material layer 14. From this, it is possible to make an alignment between the pair of display electrodes 21 and the fluorescent material layers without lightening the light emitting threads 10, and moreover, it is easy to achieve automation for mass-production.

By such a structure, the size of one pixel can be shrunk from the conventional size of 3 mm×3 mm to the size of 1 mm×1 mm, thereby achieving precision 9 times higher than the related art.

Here, the diameter (1 mm) of the glass tube 11 is the same as the size of the glass tube in the related art shown in FIG. 2, and consequently, it can come off with the same extent of production, and though the number of steps of coating the fluorescent material layers onto the boat slightly increase, the production at almost the same level of cost can be performed.

Next, a second embodiment of the present invention will be described. It should be noted that the second embodiment described here is an embodiment in which the size of the light emitting threads and the like are different comparing with the first embodiment, and with respect to the drawings, FIGS. 4 and 5 used for describing the first embodiment will be referred to as they are.

Here, a glass tube 11 of 2 mm in diameter (0.15 mm in thickness) and 100 cm in total length and a boat 13 of 1.6 mm in outer diameter are taken as materials, and, fluorescent material layers 14R, 14G, 14B . . . are formed in order of red (R), green (G), blue (B) on the boat by using a dispense technique at 0.7 mm width intervals. Individual light emitting threads are formed by the same production step as the first embodiment, and are lined up, thereby fabricating a plasma tube array.

In this manner, one pixel is made highly precise toward the size of 2 mm×2 mm, and at the same time, the diameter of the tube is made two times larger than that of the related art, so that a significant improvement of the strength is realized and the preparation of the light emitting threads becomes easy, and the strength and high precision which was conventionally in the relation of trade off become compatible.

Further, when the parts are made large in size in this manner, between the fluorescent material layers 14R, 14G, 14B . . . formed on the boat, there can be provided rib-shaped partitions, and when the fluorescent materials mounted on the same boat emit light, it is possible to make the fluorescent colors not mixed.

Next, a third embodiment of the present invention will be described.

Figure 6:
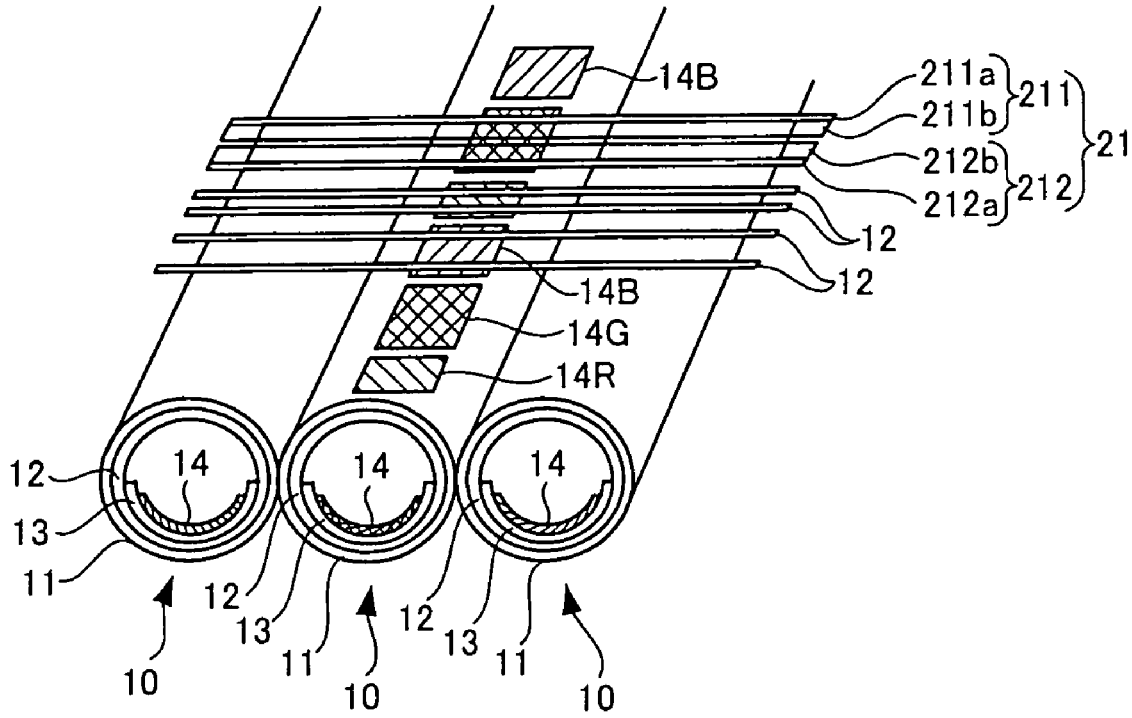
FIG. 6 is an oblique view showing the array mode of the light emitting threads of a third embodiment of the present invention.
Figure 7:
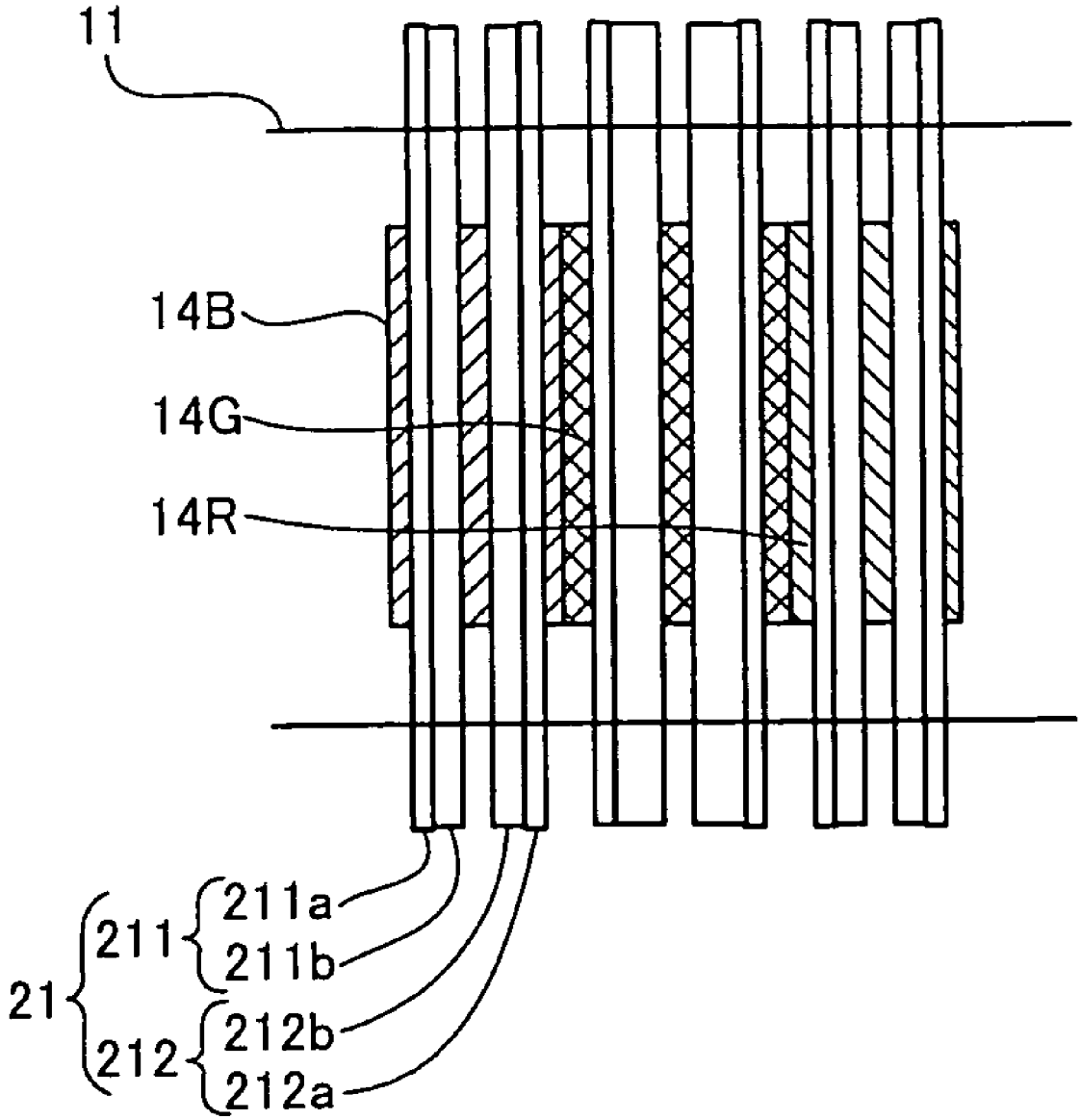
FIG. 7 is a top view showing the array mode of the light emitting threads of the third embodiment of the present invention.

FIGS. 6 and 7 are an oblique view and a top view showing the array mode of light emitting threads of the third embodiment of the present invention.

Here, the different points with the first embodiment described by referring to FIGS. 4 and 5 will be described.

Fluorescent material layers 14R, 14G, 14B . . . provided in light emitting threads shown in FIGS. 6 and 7 are different in width in the alignment direction for each type, and as far as shown here, the width of the fluorescent material layer 14G that emits the fluorescent light of green (G) is the most widest, and a pair of display electrodes 21 also become a pair of display electrodes having the width according to the size of the fluorescent material layer. It should be noted that the pair of display electrodes 21, similarly to each of the preceding examples, have two pieces of display electrodes 211 and 212, and each of the display electrodes 211 and 212 is made up of bus electrodes 211*a* and 212*a* made of metal and transparent electrodes 211*b* and 212*b*. However, in FIG. 6, the pair of display electrodes 211 and 212 alone, which correspond to the fluorescent material layer 14G, show the transparent electrodes 211*b* and 212*b*, and for other display electrodes, the transparent electrodes are omitted to be shown.

Although the fluorescent material layers 14R, 14G, 14B . . . are different in light emitting efficiency for each type, in case of the third embodiment shown in FIGS. 6 and 7, and the fluorescent material layers 14R, 14G, 14B . . . are different in width in the alignment direction for each type, the light quantity of the fluorescent lights emitted from those fluorescent material layers 14R, 14G, 14B . . . is adjusted to be at the same level for the image signal of the same level. By so doing, there is no need to perform correction for adjusting the emission light quantity for each fluorescent light color on the image signal, and by that much, the signal processing of the image signal becomes easy.

Next, a fourth embodiment of the present invention will be described.

Figure 8:
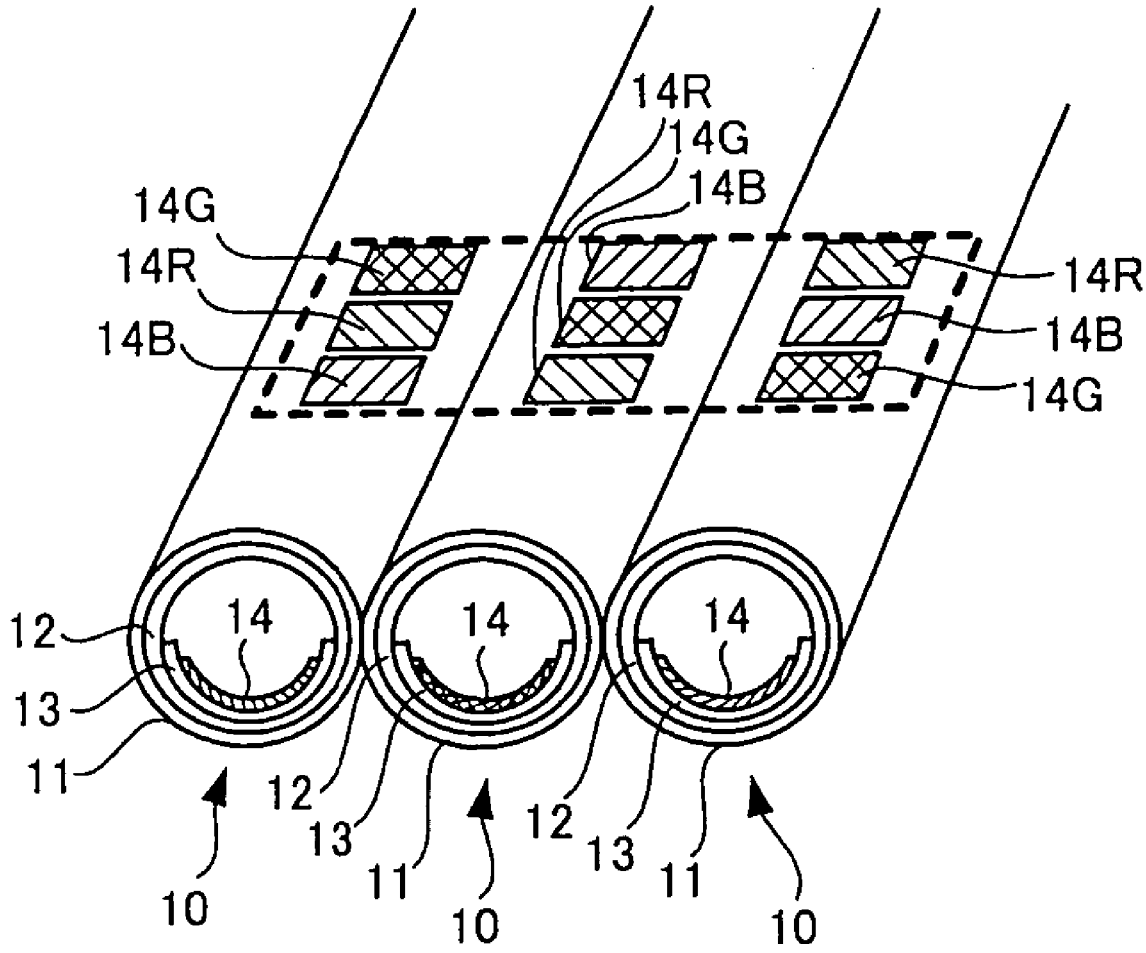
FIG. 8 is a view showing the array mode of the light emitting threads in a fourth embodiment of the present invention.

FIG. 8 is a view showing an array mode of light emitting threads in the fourth embodiment of the present invention. Here, the different points with the first embodiment described with reference to FIGS. 4 and 5 will be described.

In the present embodiment, light emitting threads 10 of the same structure and preparing method as the previously described first embodiment are used, and in FIG. 8, three pieces of light emitting threads adjacently lined up are shown. Each of the light emitting threads 10 has a boat 13 lined up in sequence with three types of the fluorescent material layers 14R, 14G, 14B . . . inserted into glass tubes 11 in the longitudinal direction.

However, in the present embodiment, on occasion of lining up the light emitting threads, as shown in FIG. 8, the position of the boat 13 is shifted by 0.03 mm by adjacent light emitting thread, whereby three types of the fluorescent material layers 14R, 14G, 14B . . . are lined up in sequence in the longitudinal direction of one piece of the light emitting thread 10, and at the same time, three types of the fluorescent material layers 14R, 14G, 14B . . . are also lined up in sequence across plural pieces of light emitting threads 10 in the extending direction of the pair of the display electrodes 21. Through such disposition, the fluorescent light colors controlled by the pair of display electrodes 211 and 212 become different in sequence depending on the light emitting threads 10. By so doing, through the present disposition, not only the resolution in x-y directions, but also the resolution in an oblique direction can be increased, and much higher image quality can be realized.

As described above, according to various embodiments described here, high preciseness, which has been extremely difficult to realize or required a considerably high cost in conventional techniques, can be realized within permissible limits of cost increase.

What is claimed is:

1. A plasma tube array, comprising:

plural light emitting tubes that each have a fluorescent layer inside thereof and are mutually lined up in parallel;

a front surface support substrate and a rear surface support substrate that holds the plural light emitting tubes between themselves;

plural display electrodes that are formed on a surface, which faces the light emitting tubes, of the front surface support substrate in the direction to cross the light emitting tubes; and plural signal electrodes that are associated with the respective light emitting tubes and formed on a surface, which faces the light emitting tubes, of the rear surface support substrate in the direction along the light emitting tubes, wherein the fluorescent layer of each of the light emitting tubes includes plural types of fluorescent materials emitting fluorescent lights of different colors, the fluorescent materials being disposed in sequence in the longitudinal direction of the light emitting tubes, and wherein the display electrodes are associated with the respective fluorescent materials that are disposed in sequence in the longitudinal direction of the light emitting tubes.

2. The plasma tube array according to claim 1, wherein the display electrodes are each formed along corresponding one of the plural types of fluorescent materials that emit in sequence fluorescent lights of different colors across the light emitting tubes.

3. The plasma tube array according to claim 1, wherein the fluorescent layer includes fluorescent materials that are disposed in sequence to be different in size in the longitudinal direction of the light emitting tubes depending on the type of the fluorescent materials.

4. The plasma tube array according to claim 1, comprising a support member in which plural types of fluorescent materials emitting fluorescent lights of different colors are disposed in sequence, wherein the support member is inserted into the light emitting tube.

* * * * *